US005281345A

United States Patent [19]

Crawford et al.

[11] Patent Number: 5,281,345

[45] Date of Patent: Jan. 25, 1994

[54] PROCESS FOR THE PREPARATION OF A LUBRICATING OIL ADDITIVE CONCENTRATE WITH AN ORGANIC HALIDE CATALYST

[75] Inventors: John Crawford, Surrey; Sean P. O'Connor; Charles Cane, both of North Humberside, all of England

[73] Assignee: BP Chemicals (Additives) Limited, London, England

[21] Appl. No.: 556,823

[22] Filed: Jul. 23, 1990

[30] Foreign Application Priority Data

Jul. 26, 1989 [GB] United Kingdom ..... 8917094

[51] Int. Cl.[5] ..... C10M 159/02; C10M 159/22; C10M 159/24

[52] U.S. Cl. ..... 252/18; 252/33; 252/33.2; 252/39; 252/42.7

[58] Field of Search ..... 252/18, 33, 33.2, 39, 252/42.7

[56] References Cited

U.S. PATENT DOCUMENTS

| | | | |
|---|---|---|---|
| 3,410,798 | 11/1968 | Cohen | 252/18 |
| 3,544,463 | 12/1970 | Koft, Jr. | 252/33 |
| 4,698,170 | 10/1987 | LeCoent | 252/18 |
| 4,737,298 | 4/1988 | Born et al. | 252/18 |

FOREIGN PATENT DOCUMENTS

| | | |
|---|---|---|
| 271262 | 6/1988 | European Pat. Off. . |
| 347103 | 12/1989 | European Pat. Off. . |
| 8803944 | 6/1988 | World Int. Prop. O. . |

*Primary Examiner*—Jerry D. Johnson

*Attorney, Agent, or Firm*—Brooks, Haidt, Haffner & Delahunty

[57] ABSTRACT

A process for the production of a lubricating oil additive concentrate comprises reacting at elevated temperature the following components:

component (A) a defined acid component (B)—a calcium base added either in a single addition or in a plurality of additions at intermediate points during the reaction, component (C)—at least one compound which is (i) water, (ii) a polyhydric alcohol having 2 to 4 carbon atoms, (iii) a di- ($C_3$ or $C_4$) glycol, (iv) a tri-($C_2$–$C_4$) glycol, (v) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, optionally, component (D)—a lubricating oil, component (E)—carbon dioxide added subsequent to the, or each, addition of component (B), and component (F)—a compound of formula II $$R^3X \quad (II)$$

wherein X is a halogen and $R^3$ is an alkyl, alkenyl or alkaryl group or halo derivative thereof.

10 Claims, No Drawings

PROCESS FOR THE PREPARATION OF A LUBRICATING OIL ADDITIVE CONCENTRATE WITH AN ORGANIC HALIDE CATALYST

The present invention relates to a process for the production of, and compositions containing a lubricating oil additive concentrate and in particular those comprising alkaline earth metal hydrocarbyl-substituted salts of acids selected from phenol (carbolic acid), sulphonic acid, naphthenic acid, salicylic acid and mixtures of any two or more thereof, i.e. phenates, sulphonates, naphthenates, salicylates and mixtures thereof, and/or their sulphurised derivatives.

In the internal combustion engine, by-products from the combustion chamber often blow by the piston and admix with the lubricating oil. Many of these by-products form acidic materials within the lubricating oil.

Compounds generally employed to neutralise the acidic materials and disperse sludge within the lubricating oil are the metal hydrocarbyl-substituted phenates, salicylates, naphthenates and sulphonates and sulphurised derivatives thereof, wherein the metal is an alkaline earth metal such as calcium, magnesium, barium or strontium. Both normal, low based and overbased alkaline earth metal hydrocarbyl-substituted phenates, salicylates, naphthenates and sulphonates and sulphurised derivatives thereof, have been employed. The term "overbased" is used to describe those alkaline earth metal hydrocarbyl-substituted salts in which the ratio of the number of equivalents of the alkaline earth metal moiety to the number of equivalents of the acid moiety is greater than one, and is usually greater than 1.2 and may be as high as 4.5 or greater. In contrast, the equivalent ratio of alkaline earth metal moiety to acid moiety in "normal" alkaline earth metal hydrocarbyl-substituted salts is one, and in "low based" salts is less than one. Thus, the overbased material usually contains greater than 20% in excess of the alkaline earth metal present in the corresponding normal material. For this reason overbased alkaline earth metal hydrocarbyl-substituted salts have a greater capability for neutralising acidic matter than do the corresponding normal alkaline earth metal hydrocarbyl-substituted salts, though not necessarily an increased detergency power.

The prior art teaches many methods for preparing alkaline earth metal hydrocarbyl-substituted salts of the aforesaid acids and their sulphurised derivatives. Whilst the details of such methods vary considerably depending amongst other factors on the nature of the product desired, generally common to all the methods is the reaction of the acid (or a metal salt thereof), in the presence or absence of sulphur, with an alkaline earth metal base and in the presence of a solvent, the product thereafter being reacted with carbon dioxide followed by a heading distillation and filtration.

The use of materials generally referred to as either promoters or catalysts in the process has also been mentioned. Thus, our copending European application publication No. 0271262 (BP Case No. 6538) discloses that as the catalyst in a process for producing high (greater than 300) Total Base Number (TBN) phenates there may be used an inorganic halide which may be either a hydrogen halide, an ammonium halide or a metal halide. Suitable catalysts are said to include hydrogen chloride, calcium chloride, ammonium chloride, aluminium chloride and zinc chloride, calcium chloride being preferred. In addition to the aforesaid catalysts our copending European applications Nos. 89305808.1 (BP Case No. 6944), 89305805.7 (BP Case No. 6952), 89305806.5 (BP Case No. 6953), 89305810.7 (BP Case No. 6983) and 89305809.9 (BP Case No. 6984) disclose the use of an ammonium alkanoate or a mono-, di-, tri- or tetra-alkyl ammonium formate or alkanoate. Many of the aforesaid materials are solids which can be difficult to disperse uniformly throughout the reaction mixture and can cause difficulties during filtration of the product.

We have now found that contrary to previous expectations there may be used as the catalyst an organic halide as defined hereinafter.

Accordingly the present invention provides a process for the production of a lubricating oil additive concentrate which process comprises reacting at elevated temperature the following components:

component (A)—at least one of (i) a sulphurised or non-sulphurised hydrocarbyl-substituted phenol or alkaline earth metal salt thereof, (ii) a sulphurised or non-sulphurised hydrocarbyl-substituted sulphonic acid or alkaline earth metal salt thereof, (iii) a sulphurised or non-sulphurised hydrocarbyl-substituted salicylic acid or alkaline earth metal salt thereof, or (iv) a sulphurised or non-sulphurised naphthenic acid or alkaline earth metal salt thereof, component (B)—a calcium base added either in a single addition or in a plurality of additions at intermediate points during the reaction, component (C)—at least one compound which is (i) water, (ii) a polyhydric alcohol having 2 to 4 carbon atoms, (iii) a di-($C_3$ or $C_4$) glycol, (iv) a tri-($C_2$–$C_4$) glycol, (v) a mono- or poly-alkylene glycol alkyl ether of the formula (I)

$$R(OR^1)_xOR^2 \qquad (I)$$

wherein R is a $C_1$ to $C_6$ alkyl group, $R^1$ is an alkylene group, $R^2$ is hydrogen or a $C_1$ to $C_6$ alkyl group and x is integer from 1 to 6, (vi) a $C_1$ to $C_{20}$ monohydric alcohol, (vii), a $C_1$ to $C_{20}$ ketone, (viii) a $C_1$ to $C_{10}$ carboxylic acid ester, or (ix) a $C_1$ to $C_{20}$ ether, optionally, component (D)—a lubricating oil, component (E)—carbon dioxide added subsequent to the, or each, addition of component (B), and component (F)—a compound of formula II $$R^3X \qquad (II)$$

wherein X is a halogen and $R^3$ is an alkyl, alkenyl or alkaryl group or halo derivative thereof.

The process of the present invention may be applied to the production of lubricating oil concentrates of normal, low-based and over-based alkaline earth metal salts of hydrocarbyl-substituted acids.

A distinction will be drawn in this specification between concentrates having (i) a Total Base Number (TBN) less than 300, which concentrates will hereinafter be referred to as low TBN concentrates and (ii) a TBN greater than 300, which concentrates will hereinafter be referred to as high TBN concentrates.

Component (A) is at least one of (i) a sulphurised or non-sulphurised hydrocarbyl-substituted phenol or alkaline earth metal salt thereof, (ii) a sulphurised or non-sulphurised hydrocarbyl-substituted sulphonic acid or alkaline earth metal salt thereof, (iii) a sulphurised or non-sulphurised hydrocarbyl-substituted salicylic acid or alkaline earth metal salt thereof, or (iv) a sulphurised or non-sulphurised naphthenic acid or alkaline earth metal salt thereof. Alternatively, component (A) may comprise a non-sulphurised acid and/or salt and a source of sulphur, for example elemental sulphur, a sulphur monohalide or a sulphur, dihalide.

Component (A) is preferably chosen from (i) or (iii), preferably (i), more preferably component (A) is an alkaline earth metal salt of a sulphurised hydrocarbyl-substituted phenol.

The hydrocarbyl substituent of the aforementioned hydrocarbyl-substituted salts and acids and their sulphurised derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is propene, 1-butene or isobutene.

It will be apparent from the foregoing that the lubricating oil additive concentrate containing the alkaline earth metal hydrocarbyl-substituted salt may be produced either from a pre-formed salt, i.e. by an up-grading process, or from the precursors of the salt.

Component (B) is a calcium base. The calcium may be added for example as calcium oxide (CaO) or as calcium hydroxide ($Ca(OH)_2$), preferably calcium hydroxide. Component (B) may be added in whole to the initial reactants, or in part to the initial reactants and the remainder in one or more portions at a subsequent stage or stages in the process. It is preferred that component (B) is added in a single addition.

As component (C) there may be used one or more polar organic compounds or water, or mixtures thereof; preferably a polar organic compound.

Suitable compounds having the formula (I) as defined herein above include the monomethyl or dimethyl ethers of (a) ethylene glycol, (b) diethylene glycol, (c) triethylene glycol or (d) tetraethylene glycol. A particularly suitable compound is methyl diglycol ($CH_3OCH_2CH_2OCH_2CH_2OH$). Mixtures of glycol ethers of formula (I) and glycols may also be employed. The polyhydric alcohol may suitably be either a dihydric alcohol, for example ethylene glycol or propylene glycol, or a trihydric alcohol, for example glycerol. The di- ($C_3$ or $C_4$) glycol may suitably be dipropylene glycol, the tri- ($C_2$ to $C_4$) glycol may suitably be triethylene glycol. Preferably component (C) is either ethylene glycol or methyl diglycol, more preferably ethylene glycol.

Component (C), may also suitably be a $C_1$ to $C_{20}$ monohydric alcohol, a $C_1$ to $C_{20}$ ketone, a $C_1$ to $C_{10}$ carboxylic acid ester or a $C_1$ to $C_{20}$ ether which may be aliphatic, alicyclic or aromatic. Examples are methanol, acetone, 2-ethyl hexanol, cyclohexanol, cyclohexanone, benzyl alcohol, ethyl acetate and acetophenone, preferably 2-ethyl hexanol. In a preferred method of producing the concentrate of the present invention, there may be used in combination (i) component (C) as defined above and (ii) a solvent.

As the solvent (ii) there may suitably be used an inert hydrocarbon, which may be aliphatic or aromatic. Examples of suitable solvents (ii) include toluene, xylene, naptha and aliphatic paraffins, for example hexane, and cycloaliphatic paraffins.

The lubricating oil additive concentrate preferably incorporates component (D). Component (D) is a lubricating oil. The lubricating oil is suitably an animal, vegetable or mineral oil. Suitably the lubricating oil is a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tri-decyladipate, or polymeric hydrocarbon lubricating oils, for example liquid polyisobutenes and poly-alpha olefins. The lubricating oil may suitably comprise from 10 to 90%, preferably from 10 to 70%, by weight of the concentrate.

Component (E) is carbon dioxide, which may be added in the form of a gas or a solid, preferably in the form of a gas. In gaseous form it may suitably be blown through the reaction mixture.

Component (F) is an organic halide of the formula:

$$R^3—X \qquad (II)$$

wherein X is halogen, which is suitably chlorine, bromine or iodine, preferably chlorine, and $R^3$ is an alkyl, alkenyl or alkaryl group or halo-derivative thereof, preferably an alkyl or alkenyl, more preferably an alkyl. $R^3$ is preferably a $C_4$–$C_{100}$ group more preferably a $C_6$–$C_{18}$ group for example $C_7$–$C_{10}$ group; where R is an alkenyl group, it can suitably be a polyisobutenyl group for example $R^3X$ may be polyisobutenyl chloride which may be a mixture of saturated chlorides or unsaturated chlorides or both. A suitable example of an organic halide of the formula (II) is octyl chloride. Mixtures of organic halides as defined above may also be employed. Suitably the amount of component (F) employed may be up to 2.0% by weight based on the weight concentrate. It is preferred that the organic halide is a liquid. Organic halides are generally liquids and in consequence are more easily dispersible than solid inorganic halides and are therefore more efficient and reduce the possibility of filtration problems.

For the production of low TBN concentrates as hereinbefore defined no further components need be used. On the other hand to produce high TBN concentrates as hereinbefore defined of acceptable viscosity (i.e. a viscosity measured at 100° C. of less than 1000 cSt, preferably less than 750 cSt, more preferably 500 cSt) it is necessary to incorporate into the reaction mixture as component (G) sufficient to provide from greater than 2 to 40% by weight, based on the weight of the concentrate, of (i) a carboxylic acid or an acid anhydride, acid chloride or ester thereof, said acid having the formula (III)

$$R^4—\underset{\underset{R^5}{|}}{CH}COOH \qquad (III)$$

wherein $R^4$ is a $C_{10}$ to $C_{24}$ alkyl or alkenyl group and $R^5$ is hydrogen, a $C_1$ to $C_4$ alkyl group or a $—CH_2COOH$ group, or (ii) a di- or polycarboxylic acid containing from 36 to 100 carbon atoms or an acid anhydride, acid chloride or ester thereof.

As regards (G) (i), this is a carboxylic acid having the formula (III) or an acid anhydride, acid chloride or ester thereof. Preferably $R^4$ is an unbranched alkyl or alkenyl group. Preferred acids of formula (III) are those wherein $R^5$ is hydrogen and $R^4$ is a $C_{10}$ to $C_{24}$, more preferably a $C_{18}$ to $C_{24}$ unbranched alkyl group. Examples of suitable saturated carboxylic acids of formula (III) include capric, lauric, myristic, palmitic, stearic, isostearic, arachidic, behenic and lignoceric acids. Examples of suitable unsaturated acids of formula (III) include lauroleic, myristoleic, palmitoleic, oleic, gadoleic, erucic, ricinoleic, linoleic and linolenic acids. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example tall, cotton, ground nut, coconut, linseed, palm kernel, olive, corn, palm, castor, soyabean, sunflower, herring and sardine oils and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (III) is stearic acid.

Instead of, or in addition to (G) (i), component (G) may be (G) (ii) a di- or polycarboxylic acid containing from 36 to 100 carbon atoms or an acid anhydride, acid chloride or ester derivative thereof, preferably an acid anhydride thereof; where (G) (ii) is used it is preferably a polyisobutene succinic acid or a polyisobutene succinic anhydride.

Typically, the amount of component (G) incorporated is 10% to 35%, more preferably 12 to 20%, for example about 16% by weight based on the weight of the concentrate.

The lubricating oil additive concentrates of the present invention may be either sulphurised or non-sulphurised. Where they are sulphurised, sulphur may be present from 1 to 6% in the concentrate, preferably from 1.5 to 3% by weight based on the weight of the concentrate.

Suitably carbon dioxide in a combined form is present in the concentrate in an amount in the range from 5 to 20, preferably from 9 to 15% by weight based on the weight of the concentrate.

Suitably the reaction of components (A)–(F) or where appropriate, (A)–(G) may be carried out at a temperature from 15° to 200° C., preferably from 60° to 180° C., though the actual temperatures chosen for various stages of the reaction may differ if desired. The reaction temperature may be restricted by the boiling point of any component of the reaction mixture (in particular the component with the lowest boiling point which may be component (C) or a solvent as defined herein if used). The pressure may be atmospheric, subatmospheric or superatmospheric.

The concentrate may be recovered by conventional means, for example by distillative stripping of component (C), or the solvent (if any).

Finally, it is preferred to filter the concentrate so-obtained.

Alternatively, the concentrate can be centrifuged.

A final aspect of the present invention provides a finished lubricating oil composition which composition comprises a lubricating oil and a lubricating oil additive concentrate prepared as hereinbefore described.

The finished lubricating oil composition may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the lubricating oil additive concentrate.

In addition to their use as additives for incorporation into lubricating oil compositions, the additive concentrates of the present invention may also find application as fuel additives.

The invention will now be further illustrated by reference to the following Examples. In all the Examples the term "TBN" (Total Base Number) is used. TBN is expressed in mg KOH/g as measured by the method of ASTM D2896. Viscosities were measured by the method of ASTM D445.

EXAMPLE 1 (according to the present invention)

Charge

| | |
|---|---|
| ADX 100 ($C_{12}$-alkyl phenol commercially available from Adibis) = | 150 g |
| lubricating oil = | 60 g |
| Methyl diglycol = | 40 g |
| Ethylene glycol = | 5 g |
| Acetic acid = | 5 g |
| $Ca(OH)_2$ = | 100 g |
| Sulphur = | 35 g |
| 1-chlorooctane = | 5 g |

Method (a) The charge was heated to 125° C./700 mm Hg and held under these conditions for 20 minutes, (b) The temperature was ramped from 145° to 165° C./700 mm Hg whilst adding a mixture of 90 g methyl diglycol and 5 g ethylene glycol, (c) The mixture was held at 165° C./700 mm Hg for 1¼ hours, (d) 26 g $CO_2$ was added at 165° C./1 bar, (e) 130 g hot lubricating oil was added and the mixture stirred for 5 minutes, (f) The mixture was stripped at 205° C./10 mm Hg, and (g) The mixture was filtered.

Product Weights

| | |
|---|---|
| Product weight = | 470 g |
| Distillate weight = | 141 g |

Product Composition after Filtration

The filtration rate was very fast. The crude sediment before filtration was 2.2% v/v.

| | |
|---|---|
| Calcium = | 10.2% w/w |
| Sulphur = | 3.9% w/w |
| $CO_2$ = | 4.2% w/w |
| TBN = | 280 mg KOH/g |
| $V_{100}$ = | 398 cSt |

EXAMPLE 2 (according to the present invention)

Charge

| | |
|---|---|
| Commercially Available Sulphurised Calcium Alkyl Phenate (250 TBN) | 230 g |
| Lubricating Oil | 26 g |
| 1-chlorooctane | 3 g |

Method a. The charge was heated to 110° C./700 mm Hg. Stearic acid (63 g) was added and the mixture stirred for 15 minutes.

b. 2-Ethyl hexanol (151 g) was added at 100°-110° C./700 mm Hg.

c. $Ca(OH)_2$ (66 g) was added at 110° C./700 mm Hg.

d. The mixture was heated to 145° C./700 mm Hg and ethylene glycol (32 g) was quickly added (one minute).

e. The mixture was held at 145° C./700 mm Hg for five minutes.

f. Carbon dioxide (66 g) was then added at 145° C./1 bar.

g. The solvent was recovered at 200° C./10 mm Hg.

h. The stripped product was filtered.

Product Weights

| | |
|---|---|
| Crude Product | 386 g |
| Distillate | 184 g |

PRODUCT COMPOSITION AFTER FILTRATION

The filtration rate was very fast. The crude sediment before filtration was 1.8% v/v.

| | |
|---|---|
| Calcium | 13.9% w/w |
| Sulphur | 1.9% w/w |
| $CO_2$ | 12.0% w/w |
| TBN | 392 mg KOH/g |
| V100 | 149 cSt |
| Chloride Content | 1940 ppm |

COMPARISON TEST (Not According to Present Invention)

Charge

As for Example 2 except that no 1-chlorooctane was included.

Method

As for Example 2

Product Weights

| | |
|---|---|
| Crude Product | 380 g |
| Distillate | 194 g |

Product Composition After Filtration

The filtration rate was very slow and difficult. The crude sediment before filtration was 6.0% v/v.

| | |
|---|---|
| Calcium | 12.7% w/w |
| Sulphur | 1.9% w/w |
| $CO_2$ | 9.3% w/w |
| TBN | 360 mg KOH/g |
| V100 | 138 cSt |

We claim:

1. A process for the production of a lubricating oil additive concentrate which process comprises reacting at elevated temperature the following components:

component (A)—at least one of (i) a sulphurised or non-sulphurised hydrocarbyl-substituted phenol or alkaline earth metal salt thereof, (ii) a sulphurised or non-sulphurised hydrocarbyl-substituted sulphonic acid or alkaline earth metal salt thereof, (iii) a sulphurised or non-sulphurised hydrocarbyl-substituted salicylic acid or alkaline earth metal salt thereof, or (iv) a sulphurised or non-sulphurised naphthenic acid or alkaline earth metal salt thereof, component (B)—a calcium base added either in a single addition or in a plurality of additions, component (C)—at least one compound which is (i) water, (ii) a polyhydric alcohol having 2 to 4 carbon atoms, (iii) a di-($C_3$ or $C_4$) glycol, (iv) a tri-($C_2$-$C_4$) glycol, (v) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, optionally, component (D)—a lubricating oil, Component (E)—carbon dioxide added subsequent to the, or each, addition of component (B), and component (F)—a compound of formula II $$R^3X \quad (II)$$

wherein X is a halogen and $R^3$ is an alkyl, alkenyl or alkaryl group or halo derivative thereof and component (F) is used in a catalytically effective amount up to 2 per cent by weight based on the weight of the concentrate.

2. A process as claimed in claim 1 wherein said process comprises reacting components (A) to (F) and component (G), component (G) being sufficient to provide from greater than 2 to 40% by weight based on the weight of the concentrate of (i) a carboxylic acid of formula (III) or acid anhydride, acid chloride or ester thereof $$R^4-\underset{\underset{R^5}{|}}{CH}COOH \quad (III)$$

where $R^4$ is a $C_{10}$ to $C_{24}$ alkyl or alkenyl group and $R^5$ is hydrogen, a $C_1$ to $C_4$ alkyl group or a $-CH_2COOH$ group or (ii) a di- or polycarboxylic acid containing from 36 to 100 carbon atoms or an acid anhydride, acid chloride or ester thereof.

3. A process as claimed in claim 2 wherein said acid of formula (III) is stearic acid.

4. A process as claimed in any one of claims 1 to 3 wherein $R^3$ is a $C_4$-$C_{100}$ alkyl group.

5. A process as claimed in claim 4 wherein $R^3$ is a $C_6$–$C_{18}$ alkyl group.

6. A process as claimed in any one of claims 1 to 3 wherein component (F) is a polyisobutenyl chloride.

7. A process as claimed in claim 1 wherein component (A) is a sulphurised hydrocarbyl substituted phenol or an alkaline earth metal salt thereof.

8. A process as claimed in claim 1 wherein component (B) is calcium hydroxide.

9. A process as claimed in claim 1 wherein component (C) is ethylene glycol.

10. A process according to claim 1 wherein said component (F) is 1-chloro octane.

* * * * *